US006805463B2

(12) United States Patent
Shieh

(10) Patent No.: US 6,805,463 B2
(45) Date of Patent: Oct. 19, 2004

(54) SHUNT ELEMENT CONTACTING STRUCTURE FOR DECORATIVE LAMP HOLDER

(76) Inventor: Whiter Shieh, 6F, No. 245, Tun Hua South Road, Sec. 1, Taipei, 106 (TW)

( * ) Notice: Subject to any disclaimer, the term of this patent is extended or adjusted under 35 U.S.C. 154(b) by 0 days.

(21) Appl. No.: 10/308,024

(22) Filed: Dec. 3, 2002

(65) Prior Publication Data

US 2004/0105270 A1 Jun. 3, 2004

(51) Int. Cl.[7] ..... H01K 1/00
(52) U.S. Cl. ..... 362/226; 362/288; 439/699.2
(58) Field of Search ..... 362/448, 436, 362/429, 430, 285, 288, 226, 252, 806, 807, 808; 439/699.2, 619, 375, 513, 514, 515, 188; 200/51.1

(56) References Cited

U.S. PATENT DOCUMENTS 1,536,332 A * 5/1925 Rosendal ..... 200/51.1
3,783,437 A * 1/1974 Graff et al. ..... 439/619
6,053,774 A * 4/2000 Lin ..... 439/619
6,257,740 B1 * 7/2001 Gibboney, Jr. ..... 362/288
6,283,797 B1 * 9/2001 Wu ..... 439/699.2
6,344,716 B1 * 2/2002 Gibboney, Jr. ..... 315/185 S
6,347,965 B1 * 2/2002 Pan ..... 439/699.2

* cited by examiner

*Primary Examiner*—Thomas M. Sember
*Assistant Examiner*—Hargobind S. Sawhney
(74) *Attorney, Agent, or Firm*—Rosenberg, Klein & Lee

(57) ABSTRACT

A shunt element contacting structure for decorative lamp holder mainly includes two contacting plates correspondingly fixed to an inner wall surface of a decorative lamp holder and each having an inward projected elastic portion, and a holding member radially inward extended from the inner wall surface of the lamp holder to hold a shunt element thereto. When a decorative lamp is inserted into the lamp holder with two leads in contact with the two contacting plates, the two elastic portions are also radially outward pushed by a lower portion of the decorative lamp to disengage from two ends of the shunt element on the holding member. And, when the decorative lamp is removed from the lamp holder, the elastic portions of the contacting plates resume to their radially inward projected positions to contact with two ends of the shunt element to thereby provide a shunt path.

6 Claims, 6 Drawing Sheets

SHUNT ELEMENT CONTACTING STRUCTURE FOR DECORATIVE LAMP HOLDER

BACKGROUND OF THE INVENTION

1. Field of the Invention

The present invention relates to a shunt element contacting structure for decorative lamp holder, and more particularly to an elastic shunt element contacting structure for decorative lamp holder.

2. Description of the Prior Art

Decorative lamps are frequently used in many festivals. Normally, such decorative lamps are arranged to appear in the form of light strings. That is, a plurality of lamp holders are electrically connected to a pair of electrical wires in series, and each lamp holder is adapted to connect a decorative lamp thereto. Since the decorative lamps in the same light string are serially connected to each other, burning out or removal of any one of the decorative lamps from the lamp holder would cause interruption of the circuit of the whole light string and result in extinguishing of all other lamps in the light string. Meanwhile, decorative lamps usually include bulbs that normally have short usable life and tend to become damaged, and therefore require frequent replacement. For general users, such replacement of decorative lamps on a light string is extremely labor and time consuming. A lamp holder with shunt circuit has been developed in an attempt to solve the above-mentioned problem, so that current can still be supplied via a shunt when the decorative lamp mounted in the lamp holder becomes damaged or is removed from the lamp holder.

In a conventional shunt circuit, there is included a shunting wire wound between filaments inside the bulb of the decorative lamp. The shunting wire is generally made of aluminum oxide. When the filaments are burned out, the shunting wire provides a shunt path for current to flow therethrough. The above-described shunting structure is provided inside the bulb of the decorative lamp and therefore involves very complicate manufacturing process. Moreover, the above shunting structure solves only the problem of a burned-out decorative lamp in a lamp holder. That is, the lamp holder would still become open-circuited when the decorative lamp is removed from the lamp holder.

SUMMARY OF THE INVENTION

It is therefore a primary object of the present invention to provide a shunt element contacting structure for decorative lamp holder, in which a shunt element is mounted in the lamp holder instead of the decorative lamp.

Another object of the present invention is to provide a shunt element contacting structure for decorative lamp holder, in which two elastic contacting plates are adapted to automatically contact with and disengage from a shunt element mounted in the lamp holder. When the lamp holder has a decorative lamp inserted therein in a normal manner to push the elastic contacting plates outward, the shunt element is not in contact with the contacting plates for current to directly flow through filaments in the decorative lamp. And when the decorative lamp is burned out, or when the decorative lamp is removed from the lamp holder, the elastic contacting plates are in an outward projected position to contact with the shunt element, so that the shunt element provides a shunt path to avoid failure of a whole light string due to damage of any one of the decorative lamps thereof.

To achieve the above objects, in accordance with the present invention, there is provided a shunt element contacting structure for decorative lamp holder mainly including two contacting plates correspondingly fixed to an inner wall surface of a decorative lamp holder and each having an inward projected elastic portion, and a holding member radially inward extended from the inner wall surface of the lamp holder to hold a shunt element thereto. When a decorative lamp is inserted into the lamp holder with two leads in contact with the two contacting plates, the two elastic portions are also radially outward pushed by a lower portion of the decorative lamp to disengage from two ends of the shunt element on the holding member. And, when the decorative lamp is removed from the lamp holder, the elastic portions of the contacting plates resume to their radially inward projected positions to contact with two ends of the shunt element to thereby provide a shunt path.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
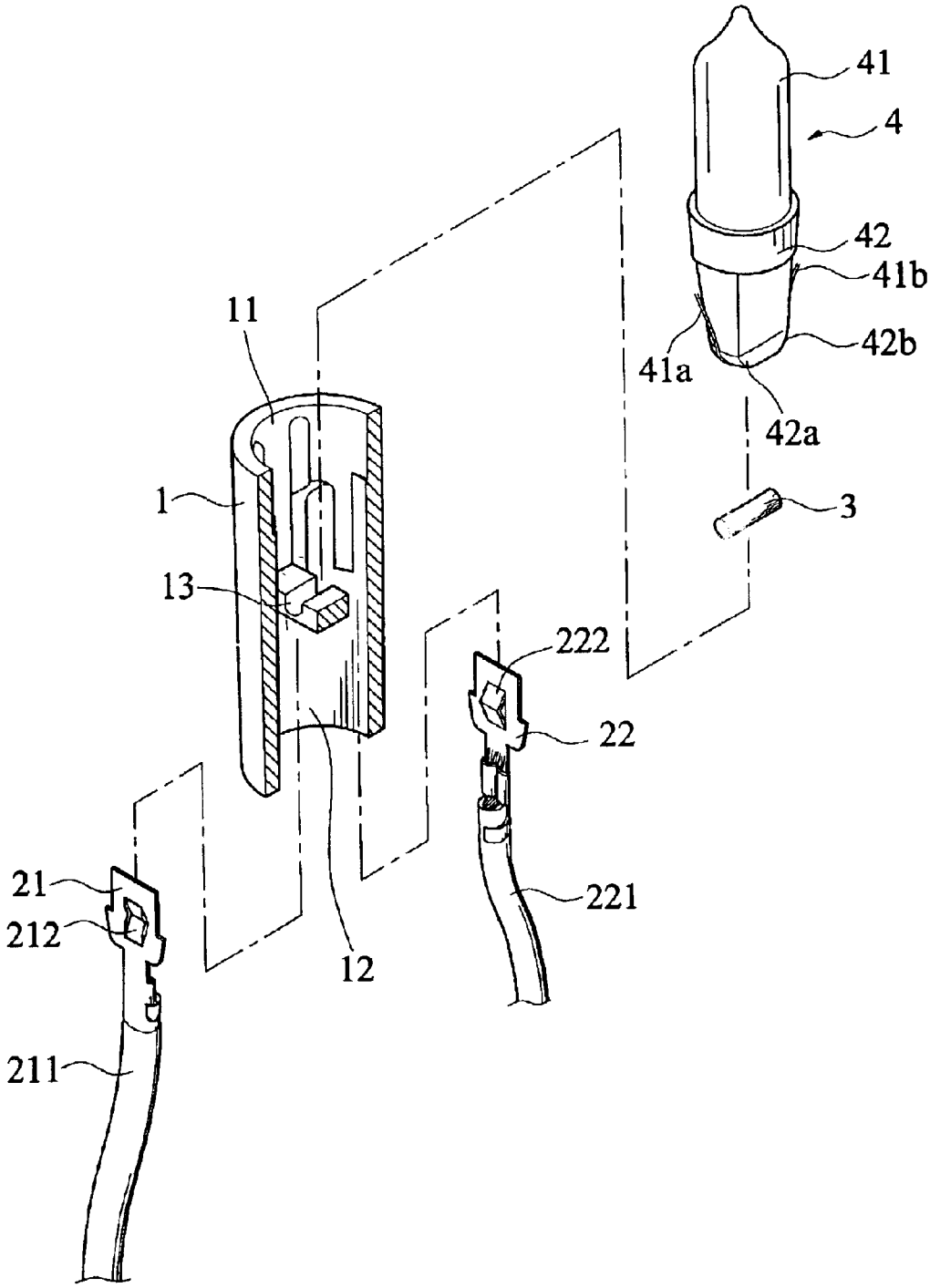
FIG. 1 is an exploded perspective view of a shunt element contacting structure for decorative lamp holder according to an embodiment of the present invention.

Please refer to FIG. 1 that is an exploded perspective view of a shunt element contacting structure for decorative lamp holder according to an embodiment of the present invention. As shown, the decorative lamp holder 1 defines an internal space and has an upper opening 11 and a lower opening 12.

Figure 2:
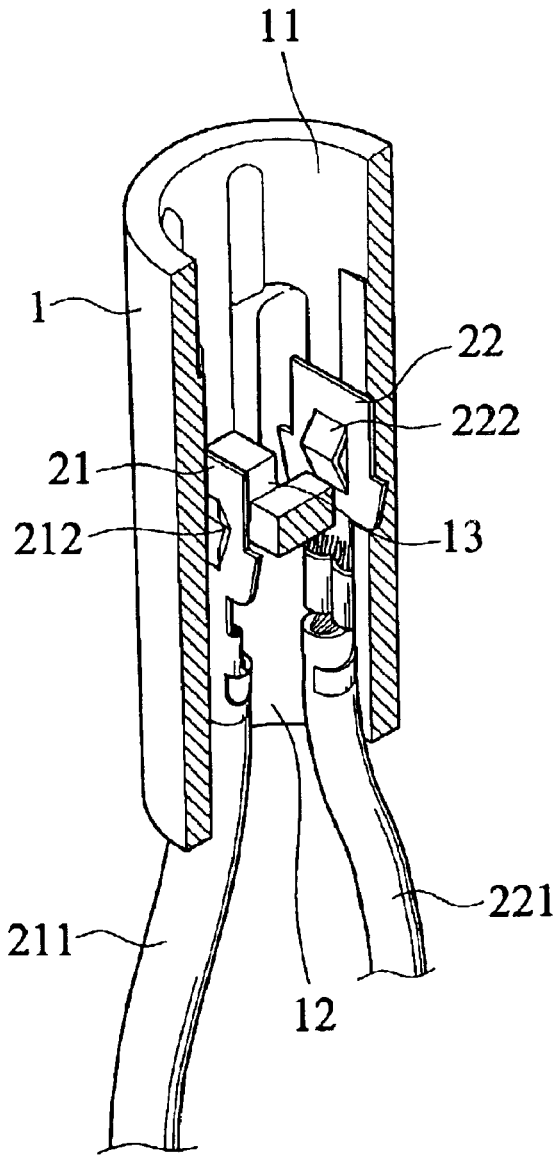
FIG. 2 is a partially sectioned perspective view of the decorative lamp holder of FIG. 1 with shunt element contacting plates mounted therein.

A first and a second contacting plate 21, 22 are correspondingly fixed to two opposite sides on an inner circumferential wall surface of the decorative lamp holder 1 and connected at respective lower ends to conducting wires 211, 221. Please refer to FIGS. 1 and 2 at the same time. The first contacting plate 21 is formed at an inner side with an inward projected V-shaped elastic portion 212 by punching at an outer side of the first contacting plate 21. That is, the elastic portion 212 includes two inclined contacting sections separately connected at an outer end to the first contacting plate 21, and a central apex located at a joint of inner ends of the two contacting sections.

Similarly, the second contacting plate 22 is formed at an inner side with an inward projected V-shaped elastic portion 222 by punching at an outer side of the second contacting plate 22. The elastic portion 222 of the second contacting plate 22 has shape and dimensions exactly corresponding to those of the elastic portion 212 of the first contacting plate 21.

The decorative lamp holder 1 is internally provided with a radially inward extended holding member 13 for stably holding a shunt element 3 thereto, such that the shunt element 3 is horizontally located between the first and the second contacting plate 21, 22.

A decorative lamp unit 4 includes a lamp 41 having two leads 41*a*, 41*b* extended from a bottom thereof, and a lamp seat 42 for receiving a lower portion of the lamp 41 therein, and may be removably connected to the upper opening 11 of the decorative lamp holder 1. When the decorative lamp holder 1 is in a state before the decorative lamp unit 4 is connected thereto, the shunt element 3 seated on the holding member 13 contacts at two ends with the inward projected elastic portions 212 and 222 of the first and the second contacting plate 21 and 22, respectively, as shown in FIG. 3.

Figure 4:
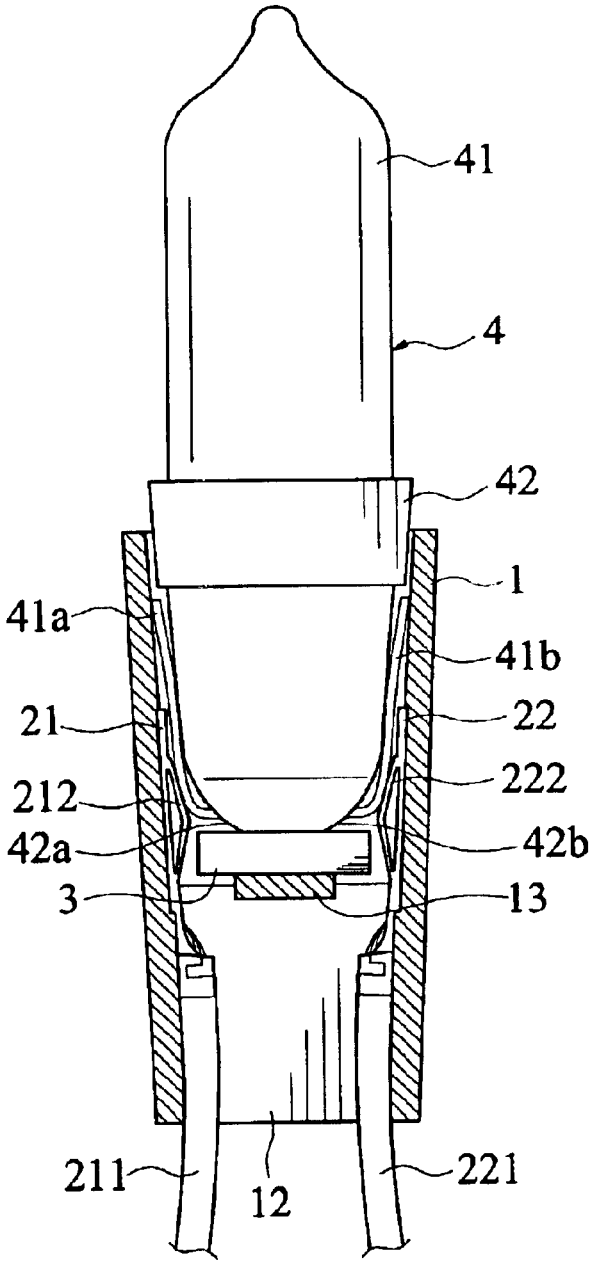
FIG. 4 is a sectional view of the decorative lamp holder of FIG. 1 with a decorative lamp unit connected thereto.

When the decorative lamp unit 4 is mounted in the upper opening 11 of the decorative lamp holder 1, as shown in FIG. 4, the two leads 41*a* and 41*b*, which are extended from the bottom of the decorative lamp 41 to an outer side of the lamp seat 42, are in contact with the first and the second contacting plate 21 and 22, respectively, enabling the decorative lamp 41 to obtain required working power supply via the first and the second contacting plate 21, 22 and the two leads 41*a*, 41*b* to emit light. With these arrangements, all decorative lamps included in the same light string can lighten normally.

As can be seen from FIG. 4, when the leads 41*a*, 41*b* are in contact with the first and the second contacting plate 21, 22, two lower opposite sides 42*a*, 42*b* of the lamp seat 42 also push the inward projected elastic portions 212, 222 of the first and the second contacting plate 21, 22, respectively, toward two radially outward positions, causing the two ends of the shunt element 3 to disengage from the elastic portions 212, 222.

Figure 3:
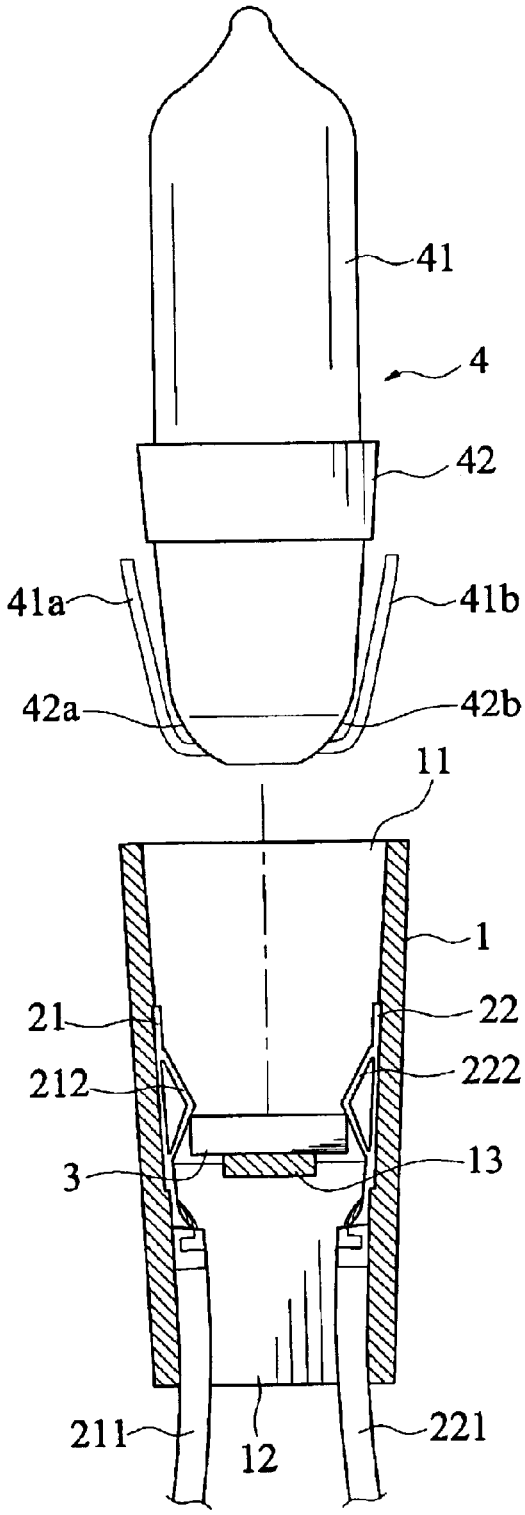
FIG. 3 is a sectional view of the decorative lamp holder of FIG. 1 before a decorative lamp unit is connected thereto.

When the decorative lamp 41 of the decorative lamp unit 4 is burned out or when the whole decorative lamp unit 4 is removed from the decorative lamp holder 1 to release the elastic portions 212, 222 of the contacting plates 21, 22 from the radially outward pressure applied thereto by the decorative lamp unit 4, the shunt element 3 is able to contact at two ends with the inward projected elastic portions 212, 222 again to resume the state shown in FIG. 3. At this point, the shunt element 3 provides a current path between the first and the second contacting plate 21, 22. Therefore, in a light string using the decorative lamp holders 1 and the decorative lamp units 4 of the present invention, any individual decorative lamp unit 4 having a burned-out lamp 41 or being removed from the lamp holder 1 would not affect the normal lightening of all other lamps 41 in the whole light string at all.

Figure 5:
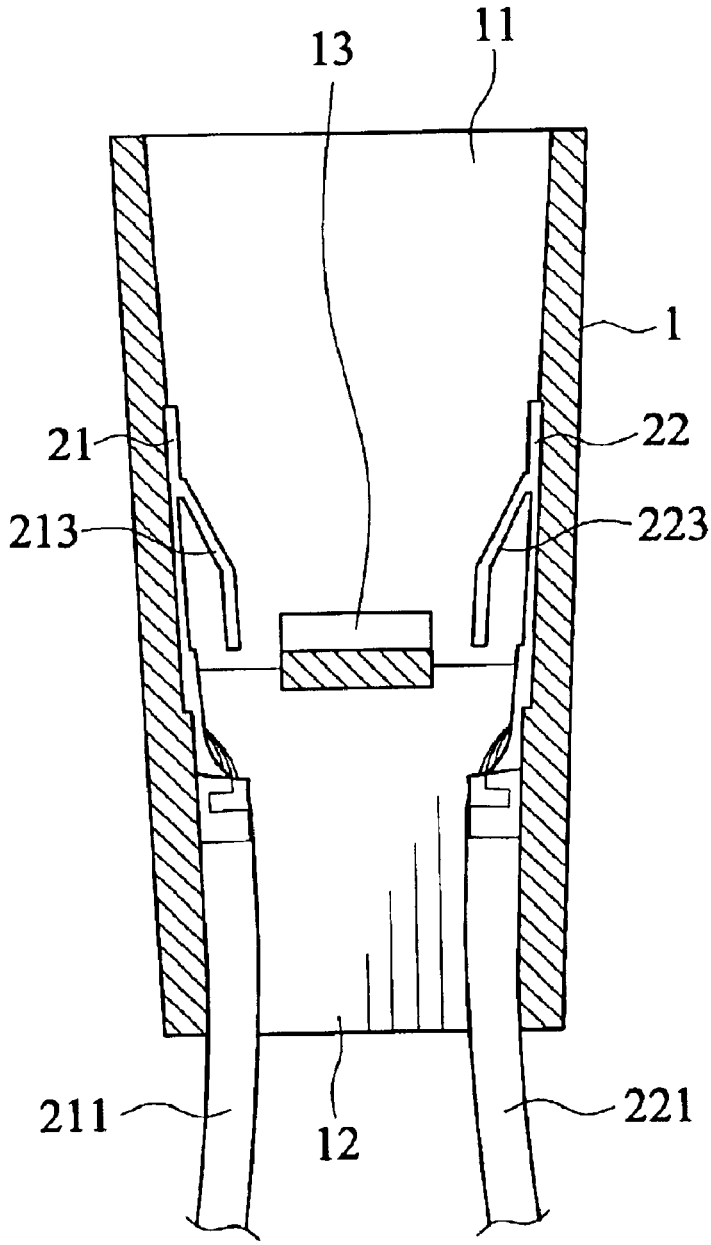
FIG. 5 is sectional view of a decorative lamp holder according to another embodiment of the present invention.

FIG. 5 shows another embodiment of the present invention, in which the first and the second contacting plate 21, 22 are punched at respective outer sides to form two inward projected elastic leaflets 213, 223. That is, the elastic leaflets 213, 223 have an upper end connected to the contacting plates 21, 22 and a downward and radially inward inclined lower elastic free end.

Figure 6:
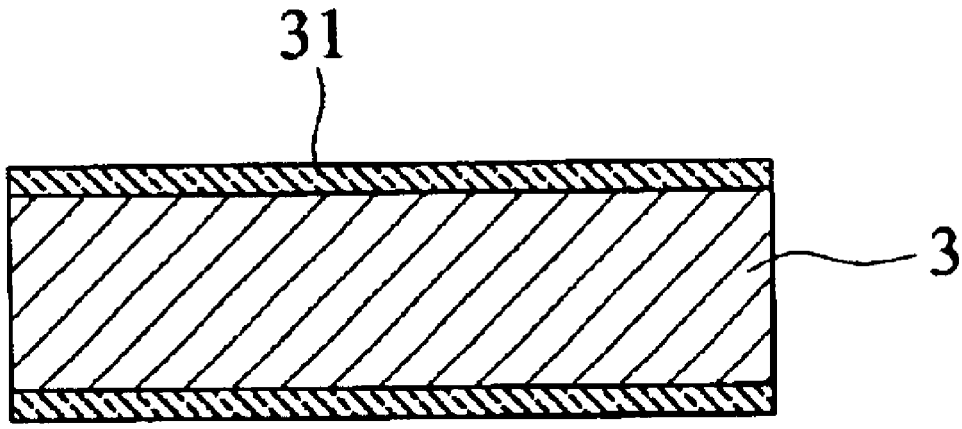
FIG. 6 is a sectional view showing a shunt element of the present invention is circumferentially covered with an insulating layer.

The shunt element 3 may be made of an electrically conducting material or aluminum oxide. Moreover, the shunt element 3 may be externally circumferentially covered with an insulating layer 31, as shown in FIG. 6, so that the shunt element 3 seated on the holding member 13 in the decorative lamp holder 1 with one decorative lamp 41 mounted in the upper opening 11 of the lamp holder 1 would not cause a short circuit between the two leads 41*a*, 41*b* of the lamp 41.

The present invention has been described with some preferred embodiments thereof and it is understood that many changes and modifications in the described embodiments can be carried out without departing from the scope and the spirit of the invention as defined by the appended claims.

What is claimed is:

1. A shunt element contacting structure for a decorative lamp holder, comprising:

a decorative lamp holder having an inner circumferential wall surface and a holding member extending transversely therefrom, the decorative lamp holder defining an upper opening for receiving a decorative lamp having two leads;

a first contacting plate fixed at a predetermined position on the inner circumferential wall surface of the decorative lamp holder, and having an inward projected elastic portion biased to a projected position;

a second contacting plate fixed at a predetermined position on the inner circumferential wall surface of the decorative lamp holder opposite to the first contacting plate, and having an inward projected elastic portion biased to a projected position opposing the elastic portion of the first contacting plate; and a shunt element set in the holding member of the decorative lamp holder, the shunt element disposed between the elastic portions of the first and second contacting plates for selective contact therewith, the shunt element being captured between the elastic portions responsive to the elastic portions each being in the respective projected positions thereof and released responsive to at least one of the elastic portions being deflected from the projected position thereof by the decorative lamp being inserted into and connected to the decorative lamp holder.

2. The shunt element contacting structure for decorative lamp holder as claimed in claim 1, wherein the elastic portions of the first and second contacting plates are two inward projected V-shaped portions formed by punching at an outer side of the first and second contacting plates, and each of the two V-shaped portions including two connecting sections separately connected at an outer end to the first or the second contacting plate and an apex located at a joint of two inner ends of the two connecting sections.

3. The shunt element contacting structure for decorative lamp holder as claimed in claim 1, wherein the elastic portions of the first and second contacting plates are two inward projected leaflets formed by punching at an outer side of the first and second contacting plates, and each of the leaflets includes an upper end connected to the first or the second contacting plate and a downward and radially inward inclined lower elastic free end.

4. The shunt element contacting structure for decorative lamp holder as claimed in claim 1, wherein the shunt element is made up of an electrically conducting material.

5. The shunt element contacting structure for decorative lamp holder as claimed in claim 1, wherein the shunt element is made up of aluminum oxide.

6. The shunt element contacting structure for decorative lamp holder as claimed in claim 1, wherein the shunt element is externally circumferentially covered with an insulating layer.

* * * * *